United States Patent [19]

Martino

[11] 4,273,043

[45] Jun. 16, 1981

[54] LABEL MAKING APPARATUS

[76] Inventor: Peter V. Martino, 99-60 65th Rd., Rego Park, N.Y. 11374

[21] Appl. No.: 84,671

[22] Filed: Oct. 15, 1979

[51] Int. Cl.[3] ..... B41F 9/00

[52] U.S. Cl. ..... 101/143; 101/213; 101/217; 101/227; 101/232; 101/366; 101/415.1

[58] Field of Search ..... 101/226–228, 101/231–235, 224–225, 242, 335, 364, 366, 367, 148, 382 R, 415.1, 212–213, 216–217, 174–175, 176, 178, 181, 347–350, 142–143

[56] References Cited

U.S. PATENT DOCUMENTS

| | | | |
|---|---|---|---|
| 1,965,596 | 7/1934 | Kline | 101/364 X |
| 2,590,179 | 3/1952 | Johnson | 101/232 |
| 2,887,951 | 5/1959 | Strother et al. | 101/232 |
| 3,160,095 | 12/1964 | Luby | 101/227 |
| 3,354,823 | 11/1967 | Lake | 101/366 X |
| 3,504,626 | 4/1970 | Worthington | 101/148 |
| 3,591,279 | 7/1971 | Gardner | 101/227 X |
| 3,603,255 | 9/1971 | Horner | 101/415.1 X |
| 3,828,673 | 8/1974 | Gazzola | 101/232 |
| 3,890,893 | 6/1975 | Kodis | 101/227 X |
| 3,951,061 | 4/1976 | Bremmer, Jr. et al. | 101/227 X |

FOREIGN PATENT DOCUMENTS

| | | | |
|---|---|---|---|
| 2715599 | 10/1978 | Fed. Rep. of Germany | 101/366 |
| 348973 | 11/1960 | Switzerland | 101/148 |
| 289171 | 4/1928 | United Kingdom | 101/364 |
| 329581 | 5/1930 | United Kingdom | 101/364 |

*Primary Examiner*—E. H. Eickholt

*Attorney, Agent, or Firm*—Anthony J. Casella; Michael A. Stallman

[57] ABSTRACT

An apparatus for printing labels is disclosed, and more particularly a portable apparatus which will reproduce indicia of a master sheet on a continuous web substrate and thereafter cut the web into individual labels. The apparatus is provided with a rotatable plate roller, to which the master sheet is attached. A fountain solution module is provided which applies a fountain solution to the surface of the master sheet, and an ink module is provided which supplies ink to the master sheet in the areas which the fountain solution has not adhered. A blanket roller is provided having a diameter equal to the plate roller and is in contact therewith. The plate and blanket rollers are driven at equal speed such that the ink on the plate roller will be accurately transferred to the blanket roller. In addition, a freewheeling impression roller is provided which is mounted for reciprocating movement into and out of contact with the blanket roller. During a printing operation, a micro-switch actuates a solenoid which selectively moves the impression roller into contact with the blanket roller such that a continuous web fed adjacent the nip between the blanket and impression rollers is drawn therethrough thereby transferring the ink to the continuous web. A second micro-switch is provided to deactivate the solenoid thereby halting the printing operation and a third micro-switch is provided to activate a cut-off means for sizing the label. The positioning of the micro-switches may be varied to vary the size of the label.

15 Claims, 7 Drawing Figures

LABEL MAKING APPARATUS

FIELD OF THE INVENTION

The subject invention relates to an apparatus for printing labels and more particularly to a portable apparatus which will reproduce the indicia of a master sheet on a continuous web substrate and thereafter cut the web into individual labels. Further, the subject invention combines the use of high speed off-set printing with a new and improved control means to produce accurately printed and sized labels from a continuous web.

DESCRIPTION OF THE PRIOR ART

Small, desk type label making devices are commonly used by small companies which require large quantities of labels for shipping and other uses. The label makers originally found in the prior art required the use of a factory precut rubber mat which acted as a die stamp and was attached to the label maker. Every time a change in the label was desired, it was necessary to fabricate an entire new rubber mat. These label makers functioned as simple stamping devices wherein printers ink was applied to the rubber mat which was used to die stamp the label.

The ink used in these prior art label makers was a non-drying oil type ink, such as carbon blak or powdered graphite, which when applied to a paper web will after a time period soak in, thereby becoming a permanent marking. Since the ink was non-drying, the time period required to permit the ink to soak into the web inhibited the immediate use of the labels since smudging of the ink would result if the labels were handled prior to the ink soaking below the surface of the paper. In addition, oil based ink could not be used to print on metal foil or the like since the ink could not penetrate past the surface of the substrate.

Subsequent developments in label making devices included the substitution of the rubber mat with a thin paper cut-out stencil which was less expensive to produce. More particularly, and as disclosed in U.S. Pat. No. 3,948,169 to Cole, a stencil having cut-outs corresponding to the mirror image of the indicia to be printed was formed on a master sheet and wrapped around an inking cylinder. Ink would then be permitted to ooze through the cut-outs in the stencil to be printed onto a continuous web of material.

The stencil used in the label makers of the prior art was generally a thin piece of rice paper which could be easily cut to form the mirror image indicia. In using a stencil, however, a loss of clarity of characters is always present due to the limitations of the stencils themselves. Further, the use of a stencil limits the amount of indicia and more particularly, the amount of large blocked out areas which may be printed because as the size of cut-out areas on the rice paper increases, the structural integrity of the rice paper is progressively weakened resulting in a stencil that will fall apart. In addition, while stencils are relatively less expensive to produce then a rubber mat, certain fixed costs are involved in cutting out the rice paper to form the stencils.

While the label maker disclosed in U.S. Pat. No. 3,948,169 is capable of printing labels of fixed length, often it is desirable to be able to print different size labels for different applications. To provide the ability to vary the length of the printed label, various expedients were developed in the prior art, for example, in U.S. Pat. No. 3,460,474 to Follis. In the latter patent, a web feed roller is provided with an internal mechanical structure which could selectively vary the radius of certain parts of the roller. By this arrangement, the areas of the roller where the radius was thickened, would come into contact with a second roller and thus be capable of drawing the web substrate therebetween. The arrangement disclosed in U.S. Pat. No. 3,460,474 to Follis includes a web feed roll having a rubber blanket covering, the arcuate extent of which can be adjusted relative to the periphery of the web roll. The latter includes an adjusting knob, inner and outer drums, a bridge plate, welded clips, shaft screws, etc. to provide for adjustments of label length. The multiplicity of integrated parts disclosed in U.S. Pat. No. 3,460,474 is susceptible to breakage or misalignment, thereby increasing down time and increasing costs.

Accordingly, it is an object of the subject invention to provide a portable apparatus which can produce labels from a master sheet which may be produced at substantially reduced costs.

It is another object of the subject invention to provide an apparatus for printing labels which uses a fast drying oxidizing ink which may be applied to various substrates including paper and metal foil.

It is a further object of the subject invention to provide an apparatus for printing labels wherein the length of the printed matter on the labels may be easily and infinitely varied with a new and improved control mechanism.

It is still another object of the subject invention to provide an apparatus for printing labels wherein the new and improved control mechanism for varying the length of the labels is easily adjusted.

It is still a further object of the subject invention to provide an apparatus for printing labels which is adapted to utilize a master sheet which may be easily produced at reduced costs on an office typewriter or photocopying machine.

It is still another object of the subject invention to provide an apparatus for printing labels which is provided with a new and improved ink feeding module.

It is still a further object of the subject invention to provide an apparatus for printing labels which is provided with a new and improved fountain solution module.

SUMMARY OF THE INVENTION

In accordance with these and many other objects, the subject invention provides for an apparatus which reproduces the indicia of a master sheet on a continuous web for printing and sizing labels. More particularly, a portable table top label making apparatus is provided which includes a rotatable plate roller having a means for attaching a master sheet thereto. The master sheet may be a photographic negative, or a sheet printed on an office typewriter or may merely be a photocopy of words or marks or any combination thereof. In accordance with the techniques of offset printing, a fountain solution module is provided to supply a fountain solution, essentially consisting of water, to the surface of the master sheet attached to the rotatable plate roller. The fountain solution module consists of a pair of rollers which functions to transfer the fountain solution from a fountain solution reservoir to the master sheet. As is well known in the offset printing art, the fountain solution will adhere to the portions of the master sheet which are hydrophilic, that is, the areas of the master sheet which are devoid of printed matter. In contrast, the printed areas, or hydrophobic areas will repel the fountain solution.

The apparatus of the subject invention further includes an ink module positioned to supply ink to the master sheet on the plate roller after the master sheet has been supplied with the fountain solution. The ink module consists of a pair of rollers which transfers a thin film of fast drying oxidizing ink from an ink reservoir to the surface of the master sheet. Again, as well known in the art of offset printing, the ink from the ink module will adhere to the master sheet only in the areas which the fountain solution has not adhered. Thus, a layer of ink will form superimposed over the pattern of the printed material on the master sheet. The plate roller is continuously driven by a motor such that the ink pattern is continuously reinforced on the master sheet with ink from the ink reservoir.

A blanket roller is provided having a diameter equal to the diameter of plate roller and is positioned in contact therewith. The blanket roller is directly geared to the plate roller and rotated at the same peripheral surface speed, to insure the precise and continual transfer of ink from the plate roller to the blanket roller. The subject apparatus further includes an impression roller which is mounted for reciprocating movement into and out of contact with the blanket roller. A means for selectively moving the impression roller into or out of contact with the blanket roller is provided and a control means for actuating the moving means is provided. More particularly and in accordance with the subject invention, a series of micro-switches are provided which are actuated by the rotation of either the blanket or the plate roller to selectively move the impression roller into and out of contact with the blanket roller. When the impression roller is moved into contact with the blanket roller, the blanket roller will cause the free wheeling impression roller to rotate thereby drawing the continuous web of material therebetween. The ink pattern on the blanket roller, which has been received from the plate roller is then transferred to the continuous web thereby printing the label. Printing of the web continues until a second micro-switch is activated which causes the impression roller to be activated to a position away from the blanket roller thereby stopping the printing operation. In the preferred embodiment, a third micro-switch is provided which activates a cutting means to sever the label at the proper size.

The apparatus of the subject invention further includes a new and improved ink reservoir for supplying ink to the inking rollers. More specifically, a generally triangular-shaped, longitudinally-extending, ink reservoir is provided which is adapted to contain an elongated plastic sleeve, open at one end and containing the fast drying oxidizing ink. The ink reservoir is provided with a top cover which is hinged for pivotal movement to put pressure on the plastic sleeve, placed in the reservoir. The downward movement of the top cover of the ink reservoir functions to squeeze the ink out of the open end of the plastic sleeve and onto the inking roller. The ink reservoir is further provided with an arcuate back edge to allow for the precise pivoting movement of the top cover to insure that a high percentage of the ink can be removed from the plastic sleeve. A screw means for adjusting the downward biasing force on the top cover is provided to control the amount of ink squeezed out of the plastic sleeve. The screw means is connected to a clear plastic cover plate such that the operator can view both the amount of ink being applied to the roller and the amount of ink remaining in the plastic sleeve. In addition, the ink reservoir is provided with a tapered lower edge which abuts the first inking roller and functions as a doctor blade for manufacturing a thin uniform layer of ink on the roller.

Further objects and advantages of the present invention will become apparent from the following detailed description taken in conjunction with the drawings in which.

Figure 1:
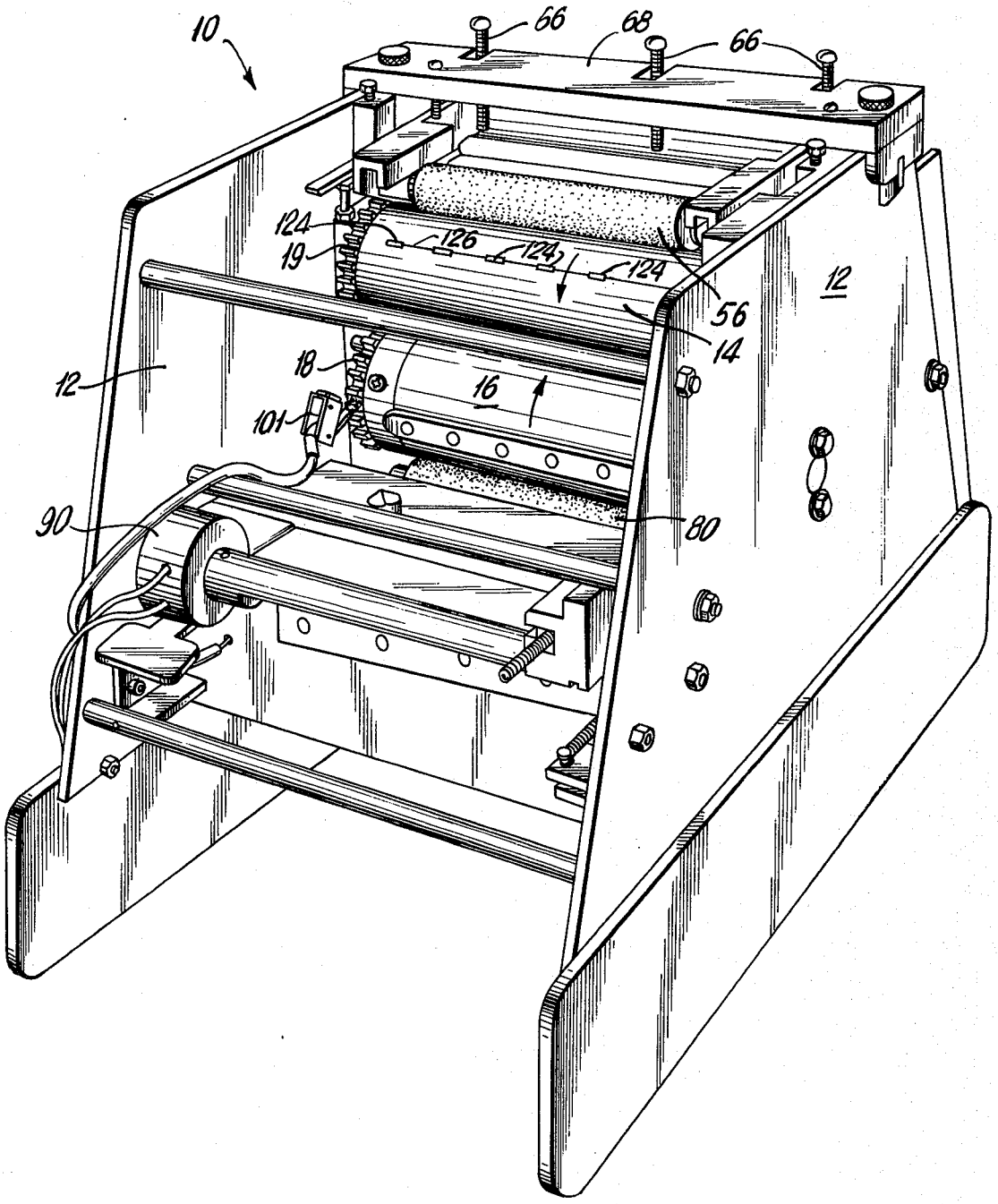
FIG. 1 is a perspective view of the label making apparatus of the subject invention.
Figure 2:
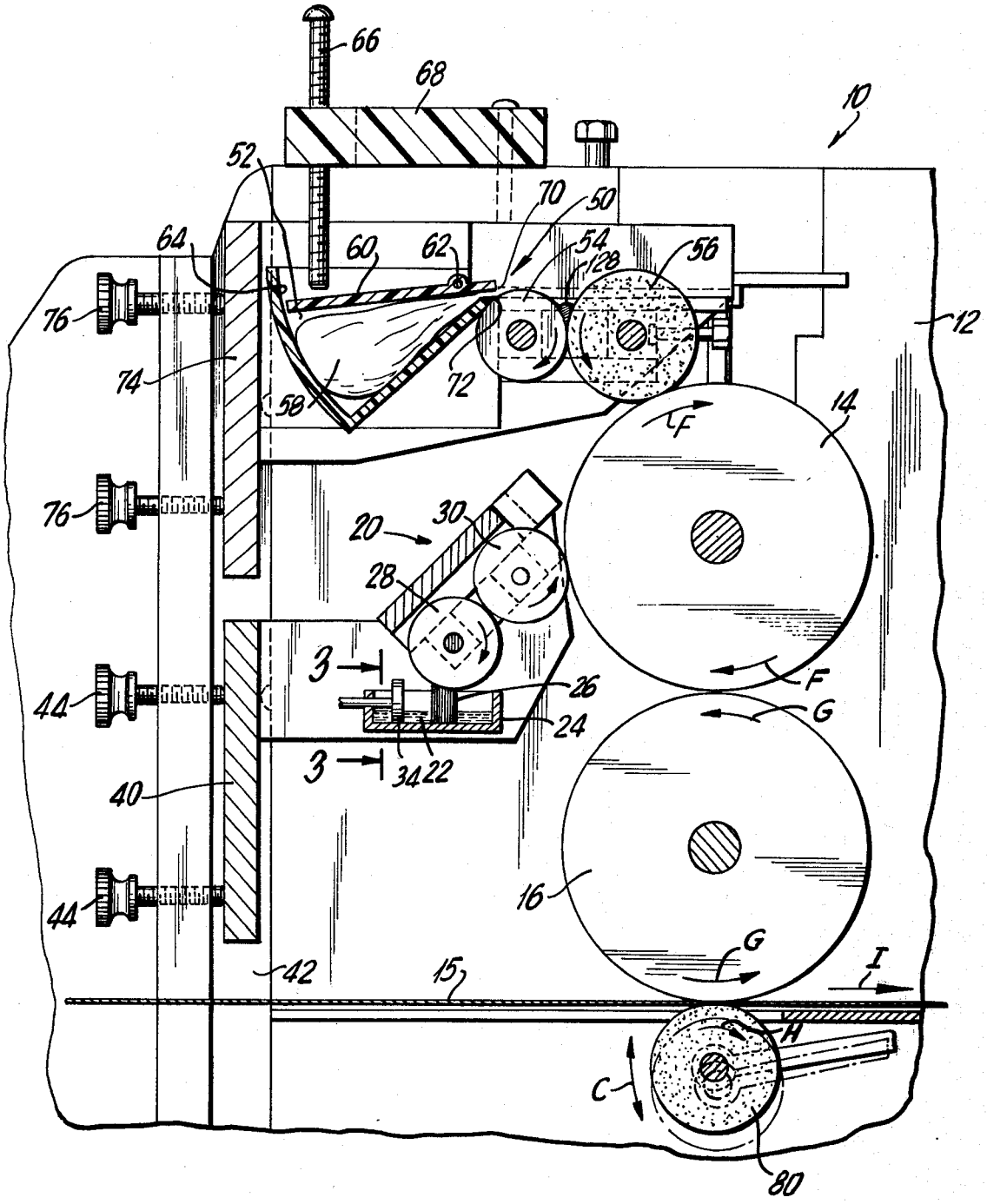
FIG. 2 is a schematic side view of the label making apparatus of the subject invention.

Referring now more specifically to FIGS. 1 and 2, the label making apparatus of the subject invention is designated generally by the numeral 10 and includes a frame 12 providing support for the components housed therein. The apparatus 10 is intended to be portable, with the frame 12 being placed on any suitable flat surface such as a table top. A rotatable plate roller 14 is provided and is directly driven by a motor (not shown). Directly below the plate roller 14 and in contact therewith is rotatable blanket roller 16 having an elastomatic covering. Blanket roller 16 has a diameter equal to the diameter of plate roller 14 and is driven at the same surface speed as the blanket roller. In the preferred embodiment, the blanket roller is geared directly to the plate roller by teeth 18, 19 at one end of each of the respective rollers to provide precise synchronization of the rollers and eliminate any dragging or slippage which could result if they were connected by a belt or other means. The plate and blanket rollers 14, 16 are pressed together by hold down clasps (not shown) which may be released so that the rollers may be readily removed for cleaning and maintenance.

A fountain solution module, indicated generally by the numeral 20 is provided for applying a film of fountain solution 22, composed essentially of water, to the surface of the master sheet (not shown) attached to the surface of the plate roller 14. The fountain solution module 20 includes a generally trough-shaped fountain solution reservoir 24, and a wick 26 which is in contact with both the fountain solution 22 and the first rotatable fountain roller 28. A second rotatable fountain roller 30 is provided which is in contact with both the first fountain roller 28 and the plate roller 14. During the operation of the apparatus 10, the driven plate roller 14 imparts a rotation to the second fountain roller 30 which in turn causes the rotation of the first fountain roller 28. Fountain solution 22 is transferred to the master sheet on the plate roller from the reservoir 24 through the wick 26 and via the fountain rollers 28 and 30 as more fully described hereinafter.

Figure 3:
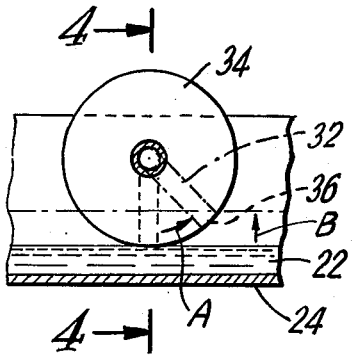
FIG. 3 is a schematic view of the control means for the fountain solution module taken along line 3—3 of FIG. 2.
Figure 4:
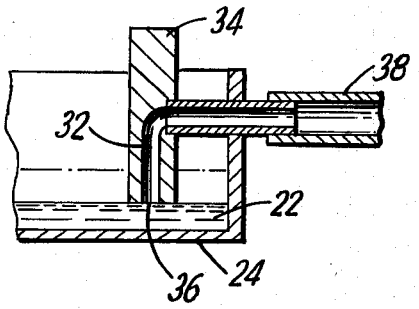
FIG. 4 is a schematic view of the control means of the fountain solution taken along line 4—4 of FIG. 3.

The depth of the fountain solution 22 contained in the fountain reservoir 24 is controlled by a movable feed pipe 32 housed in a rotatable cylinder 34 as more clearly illustrated in FIGS. 3 and 4. More specifically, a feed pipe 32 having an open end 36 is housed in a circular member 34 and mounted for rotational movement within the reservoir 24. The feed pipe 32 is connected to a conduit 38 which is, in turn, connected to a bottle (not shown) containing a supply of fountain solution. The bottle may be mounted to the side of the frame 12 in a manner such as that shown in U.S. Pat. No. 3,460,474 to Follis. The fountain solution 22 is supplied to the reservoir 24 through a gravity feed with the depth of the solution 22 in the reservoir 24 being regulated by varying the position of the opening 36 and the feed pipe 12. More specifically, the level of the fountain solution 22 in the fountain reservoir 24 will rise to the level of the open end 36 of the feed pipe 32. As illustrated in FIG. 3, when the circular member 34 is positioned such that the open end 36 of feed pipe 32 is in the downward vertical position the depth of the fountain solution 22 will rise to meet the open end 36. When the circular member 34 is rotated in the direction as indicated by arrow A, the position of the open end 36 of the feed pipe 32 is varied. This will cause the level of the fountain solution 22 to rise as indicated by arrow B to meet the level of the open end 36 of the feed pipe 32. By controlling the depth of the fountain solution 22 in the fountain reservoir 24, the amount of fountain solution 22 provided to the plate roller 14 can be regulated.

In the preferred embodiment, the fountain solution module 20 is provided with a support header 40 which is slidably received in a channel 42 formed in the frame 12 of the subject invention. The fountain solution module is held in position within the channel 42 by screws 44. By this arrangement, the fountain solution module may be easily removed from the apparatus for cleaning and maintenance by loosening the screws 44 and sliding the module 20 out of the groove 42 for dismantling. The amount of fountain solution 22 reaching the plate roller 14 may also be regulated by varying the position of the fountain solution module within the groove 42. By varying the position of the fountain solution module 22, (i.e, by slidably moving support header 40 within groove 42) the contact pressure between the second fountain roller 30 and the plate roller 14 may be varied and thus the amount of fountain solution supplied to the plate roller 14 may be varied.

An ink module, designated generally by the numeral 50 is provided to supply a quantity of fast drying oxidizing ink to plate roller 14 after a film of fountain solution 22 has been applied to the master sheet. The ink module 50 consists of a reservoir 52 and first and second inking rollers 54 and 56. The ink reservoir 52 is generally triangularly shaped and adapted to receive an elongated plastic sleeve 58 having an open end and which contains the fast drying ink. The ink reservoir 52 is provided with a top cover 60 which is hinged for reciprocal movement about pivot 62. The back edge 64 of the ink reservoir is accuately shaped to allow for the pivoting movement of the top cover 60. Downward movement of the top cover 60 causes pressure to be applied to the plastic sleeve 58 thereby causing the squeezing of ink out of the open end thereof, and onto the first inking roller 54. In the preferred embodiment, the downward biasing force on the cover plate 60 is provided by screws 66 mounted on a clear plastic cover plate 68. As the screws 66 are twisted downwardly, they create a downward biasing force on the top cover 60 of the ink reservoir 52 such that the ink in the sleeve 58 is slowly extruded out the front end 70 of the ink reservoir 52. The mounting plate 68 is formed of a clear plastic such that the amount of ink being transferred to the rollers 54, 56 is readily visible. Since the back edge 64 of the reservoir 52 is arcuately shaped, the swinging of the top cover 60 will insure that a high percentage of the ink in the plastic sleeve 58 will be extracted. The bottom side of the ink reservoir 52 is provided with a tapered tip 72 which abuts the first inking roller 54. The tapered tip 72 functions as a doctor blade to insure the ink on the first inking roller 52 is maintained at a uniform constant thickness. The ink reservoir can be divided into two or more adjacent compartments, each fitted with plastic sleeves of ink of different colors enabling the machine to print labels in different color zones to produce a finished label with two or more colors.

In operation, the driven plate roller 14 imparts a rotation to both the first and second inking rollers 54, 56 and by this arrangement, ink from the ink reservoir 52 is transferred from the reservoir to the master sheet on the plate roller 14, as more fully described hereinafter. Inking module 50 includes a support header 74 which is receivable within the channel 42 on the frame 12. Screws 76 function to lock the ink module 50 into position such that the second inking roller 56 is in contact with the plate roller 14. By this arrangement, the ink module 50 may be removed from the apparatus for easy cleaning and in addition, the contact pressure between the second inking roller 56 and the plate roller 14 may be varied, thus varying the thickness of the ink applied to the plate roller 14.

A rotatable impression roller 80 is provided which is mounted for reciprocating movement into and out of contact with the blanket roller 16 as indicated by arrow C in FIG. 2. In the preferred embodiment, the movement into and out of contact with the blanket roller 16 is effected by an electrically operated solenoid (not shown). The solenoid is controlled by a pair of micro-switches as more fully described hereinafter. The impression roller 80 is free wheeling on bearings and is rotationally driven by the blanket roller 16 when the rollers are in contact.

The subject apparatus is further provided with a cutting means 90 for severing the continuous web into individually sized labels. The cutting means 90 may consist of a rotary cutter connected to a rotary solenoid actuated by a micro-switch.

The accurate control of the printing of labels in the subject invention is provided by three micro-switches which are mounted adjacent the rotational axis of the plate roller 14 and the blanket roller 16. More specifically, a first micro-switch 101, as illustrated in FIG. 1, is mounted on the frame 12 adjacent the rotational axis of the blanket roller 16. The first micro-switch 101 is positioned such that it will be actuated by a flange (not shown) attached to one end of the blanket roller 16. The flange is positioned such that the first micro-switch 101 will be actuated to coincide with the beginning of the printing cycle. More specifically, the micro-switch 101 will be activated when the leading edge of the inked pattern on the rotatable blanket roller 16 is in the vertically downward or lowermost position. The first micro-switch 101 functions to activate the solenoid which controls the movement of the impression roller 80. The solenoid magnetically raises the impression roller 80 into contact with the blanket roller 16 such that the rotation of the blanket roller 16 will impart a rotation to the free wheeling impression roller 80. The rotation of both the impression roller 80 and the blanket roller 16 coupled with the contact pressure therebetween functions to cause the continuous web 15 to be drawn between the rollers 16, 80, thereby transferring the ink pattern from the blanket roller 16 to the web 15.

Figure 5:
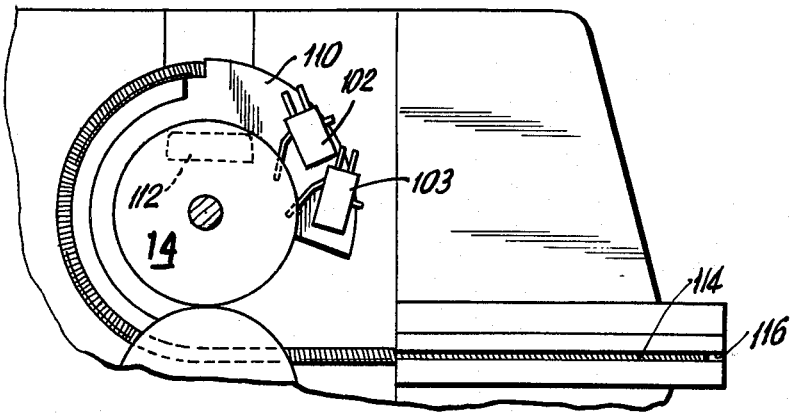
FIG. 5 is a schematic view illustrating the control means for varying the length of the printed label in the apparatus of the subject invention.
Figure 7:
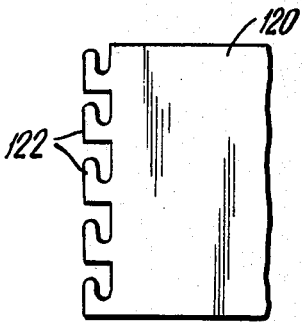
FIG. 7 is a partial elevational view of a master sheet illustrating the locking means used to attach the sheet to the plate roller of the subject invention.
Figure 6:
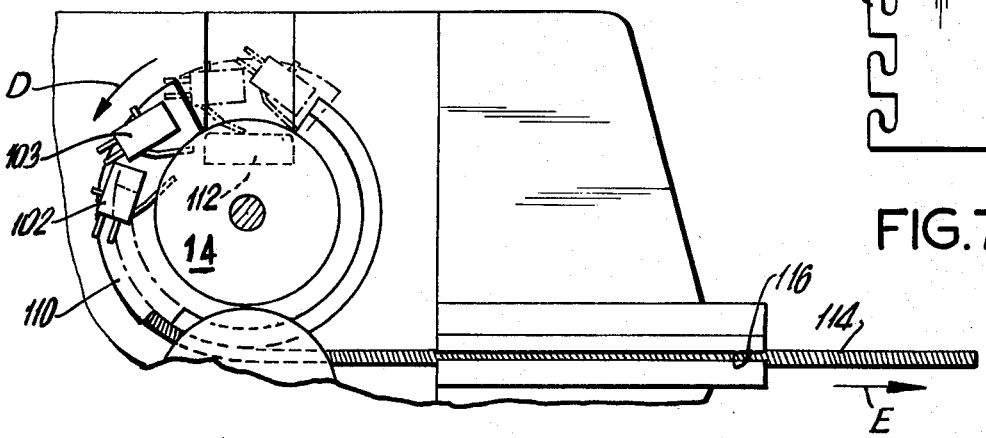
FIG. 6 is a schematic view similar to FIG. 5 showing the various positions of the micro-switches of the subject invention.

The impression roller 80 will remain in the up or actuated position until the associated solenoid (not shown) is deactivated by a signal from a second micro-switch 102. As more particularly illustrated in FIGS. 5 and 6, second micro-switch 102 is mounted adjacent the rotational axis of the plate roller 14. In accordance with the subject invention, the precise positioning of the second micro-switch 102 may be radially varied about the axis of the plate roller 14. More particularly, the position of the micro-switch 102 may be varied by adjusting the position of a spring loaded plate 110 which is mounted on frame 12. Alternatively, micro-switch 102 may be displaced by a geared pinion knob engaging the toothed exterior of plate 110. The micro-switch 102 is actuated by a flange 112 which is connected to the end of the plate roller 14 opposed to the geared end. The rotation of the plate roller 14 causes the flange 112 to trip the second micro-switch 102. As the position of the micro-switch 102 is varied, the time at which the micro-switch 102 is activated is varied relative to the actuation of the first micro-switch 101. More specifically, as the position of the plate 110 is rotated in a direction of arrow D, the micro-switch 102 will be activated earlier in the printing cycle. By this arrangement, the length of time which the impression roller 80 is in contact with the blanket roller 16 may be precisely regulated and coordinated with the size of the label to be printed. More specifically, by shifting micro-switch 102 in the direction of arrow D, the time the impression roller 80 is in the up position during each cycle is shortened, and thus the length of the label is shortened. Alternatively, when shifting micro-switch 102 in the opposite direction, the impression roller 80 will remain in contact with the blanket roller for a greater length of time thereby permitting the printing of a longer label.

The position of the movable plate 110 is controlled by the movement of cable 114 which is slidably received in a track 116 provided in the frame 12. By pulling the cable in the direction of arrow E the plate 110 is rotated in the direction of arrow D, thereby shifting the position of the micro-switch 102. By releasing a clamping mechanism (not shown) on cable 114 the spring loaded plate 110 will return to its original position, which corresponds to the maximum label length. Thus by simply moving the cable 114, the position of the micro-switch 102 may be varied and thus the length of time the impression roller 80 is in the actuated position may be varied.

In a preferred embodiment, a third micro-switch 103 is provided and is also mounted on plate 110. Micro-switch 103, which is connected to the cutting means 90 for sizing the labels, is positioned relative to micro-switch 102 such that it is actuated by flange 112 immediately after micro-switch 102 is actuated. By this arrangement, immediately after the label has been printed and the solenoid has been deactivated causing the impression roller 80 to be actuated to a position out of contact with the blanket roller 16, the third micro-switch 103 is activated which in turn activates the cutting means 90 thereby slicing the label from the continuous web 15.

While the illustrated embodiment provides for fixedly mounting the first micro-switch 101, it would be obvious to one skilled in the art to permit the position of the first micro-switch to be varied in a manner similar to the second and third micro-switches. Furthermore, the micro-switches may be arranged in a group on one roller or individually placed on either end of either the plate or blanket rollers 14, 16 with any of these modifications intended to be covered within the scope of the subject invention.

In the operation of the apparatus of the subject invention, a master sheet 120 is provided having the indicia which is to be transferred to the labels printed thereon. A plurality of master sheets 120 are preferably provided to the user in rolled form thereby giving them a precurve such that they will easily fit on the plate roller 14. The master sheet may be printed with the desired indicia by means of hand inking, standard typewriter ink, photographic means or even printed from a photocopying machine. The master sheet is provided with a plurality of L-shaped dogs 122 disposed along one end thereof. The plate roller 14 is provided with a plurality of L-shaped slots 124 aligned along a groove 126 as illustrated in FIG. 1. The master sheet is mounted on the plate roller 14 by inserting the L-shaped dogs 122 into the L-shaped slots 124 and sliding the sheet along the groove 126 to lock the dogs 122 in place. The master sheet 120 is then folded downwardly along the groove 126 to conform to the curvature of plate roller 14. The back surface of the master sheet 120 will adhere to the plate roller 14 by friction or by slightly moistening the back of the master sheet 120.

As illustrated schematically in FIG. 2, when the drive means is started the plate roller 14 is rotated in the direction of arrows F bringing the master sheet 120 into contact with the second fountain roller 30. The rotation of the plate roller 14 imparts a rotation to the fountain rollers 28, 30 which thereby transfers the fountain solution 24 to the plate roller 14. More particularly, first fountain roller 28 picks up the fountain solution from the wick 26, transfers the fountain solution to the second fountain roller 30, which in turn transfers the solution to the surface of the master sheet 120 attached to the plate roller 14. The fountain solution 22 which is composed essentially of water, will adhere to the hydrophilic areas of the master sheet or those areas which are devoid of printing.

Continued rotation of the plate roller 14 brings the master sheet 120 into contact with the second inking roller 56. The rotation of the plate roller 14 imparts a rotation to the second inking roller 56 as well as the first inking roller 54. Ink which is extruded from the plastic sleeve 58 is supplied to the first inking roller 54 which, in turn, passes it onto the second inking roller 56. In operation, a bead of ink 128 builds up between the first inking roller 54 and the second inking roller 56 which serves to constantly replenish the second inking roller 56. The inking roller 56 transfers the ink to the surface of the master sheet 120 which is attached to the plate roller 14, and adheres to the hydrophobic areas of the master sheet 120 or the areas which the fountain solution 22 has not adhered. More specifically, the areas on the master sheet which have printing are coated with a thin layer of the fast drying oxidizing ink. Further rotation of the plate roller 14 brings the inked areas in contact with the elastomeric surface of the blanket roller 16 which is rotating in the direction of arrow G. The ink on the master sheet 120 is transferred to the surface of the blanket roller 16 in mirror image fashion. Due to the fact that the blanket and plate rollers have equal diameters and are driven at equal speed in synchronization, the inked image on the blanket roller 16 is continually reinforced by every rotation of the rollers with fresh ink from the plate roller 14.

In accordance with the subject invention, the actual printing of labels is initiated when the flange on the blanket roller 16 actuates micro-switch 101. Micro-switch 101 functions to activate the solenoid which raises the impression roller 80 into contact with the blanket roller 16. The rotation of the blanket roller 16 imparts a rotation to the free wheeling impression roller 80 in the direction of arrow H. The rotation coupled with the pressure between the blanket and impression rollers 16, 80 functions to draw the continuous web 15 therebetween, (in the direction indicated by arrow I) with the web 15 accepting the mirror image of the ink pattern which is on the blanket roller 16. By virtue of this double reversal of images, the image printed on the label is the same as the image printed on the master sheet 120.

Printing of the label continues as long as the impression roller is in the activated or up position, in contact with the blanket roller 16. Printing is halted when the flange 112 of the plate roller 14 activates the second micro-switch 102 which in turn sends a signal to deactivate the solenoid, thereby causing the impression roller 80 to be lowered to a position out of contact with the plate roller 16. Since there is no longer any contact pressure between the rollers 80, 16, the movement of the continuous web 15 is halted.

In accordance with the subject invention, immediately after the activation of the second micro-switch 102 the flange 112 activates the third micro-switch 103 which controls the cutting means 90 provided at the output end of the apparatus. By this arrangement, the cutting means 90 sizes the label after the printing has been completed. The printing operation is repeated when the first micro-switch 101 is reactivated by the flange of the blanket roller 16 which, in turn, activates the solenoid to raise the impression roller 80 back into contact with the blanket roller 16.

Depending upon the amount of printing on the master sheet 120, the length of the label may be varied by varying the position of the plate 110 carrying the micro-switches 102 and 103. For example, if the label to be printed is very short, the plate may be rotated in the direction of arrow D thereby decreasing the time lag between the activation of first micro-switch 101 and second micro-switch 102. More specifically, by properly positioning second micro-switch 102 the impression roller 80 will remain in the actuated position for a time period corresponding to the length of time it takes the blanket roller 16 to rotate through an arc equal to the length of the label. Since the ink used in the apparatus of the subject invention is fast drying oxidizing ink which is applied in a relatively thin layer, the labels which are produced by the apparatus may be used virtually immediately after they are printed without risking smudging of the printed material. In addition, should the operator wish to print in more than one color, dual inking modules may be provided each having an ink of another color. Further, changing the color of ink in an individual module is relatively easy and clean since the ink is contained in a plastic sleeve rather than in a tube which must be hand squeezed onto the rollers or placed on the rollers by a spatula or other device.

Accordingly, there is provided a new and improved label making apparatus which includes a rotatable plate roller with a master sheet attached thereto. A fountain solution module is provided which supplies a fountain solution to the surface of the master sheet, and an ink module supplies ink to the master sheet in the area which the fountain solution has not adhered. A blanket roller having a diameter equal to the diameter of the plate roller is provided and is in contact with the plate roller. The blanket roller is driven at the same speed as the plate roller such that the ink on the plate roller can be accurately transferred to the blanket roller. In addition, a free wheeling rotatable impression roller is provided which is mounted for reciprocating movement into and out of contact with the blanket roller. During a printing operation, a micro-switch activates a solenoid which selectively moves the impression roller into contact with the blanket roller the rotation of which functions to draw the continuous web in between the blanket and impression rollers such that the ink is transferred to the continuous web. After the label is printed, a second micro-switch functions to deactivate the solenoid which lowers the impression roller to a position out of contact with the blanket roller, thereby stopping the printing operation. A third micro-switch activates a cutting means to accurately size a label. The position of the micro-switches may be varied which will affect the length of time that the impression roller is in contact with the blanket roller such that the size of the label which is printed may be accurately controlled.

Although the subject apparatus has been described by reference to a preferred embodiment, it will be apparent that many other modifications could be devised by those skilled in the art that would fall within the spirit and scope of the present invention as defined by the appended claims.

What is claimed is:

1. An apparatus for reproducing the indicia of a master sheet on a continuous web for printing labels comprising:

a rotatable plate roller, said plate roller having a means for attaching said master sheet thereto;

a fountain solution module for supplying a fountain solution to the master sheet on said plate roller;

an ink module positioned for supplying ink to said master sheet on said plate roller after said master sheet has been supplied with fountain solution;

a rotatable blanket roller having a diameter equal to the diameter of said plate roller, said blanket roller being in contact with said plate roller;

drive means connected to both said plate roller and said blanket roller, with said rollers being rotated at the same speed such that the ink placed on said plate roller is accurately transferred to said blanket roller;

a rotatable impression roller mounted for reciprocating movement into and out of contact with said blanket roller;

means for selectively moving said impression roller into or out of contact with said blanket roller; and control means for actuating said moving means whereby when said impression roller is brought into contact with said blanket roller, said blanket roller will cause said impression roller to rotate such that when said continuous web is fed adjacent to the nip between said blanket and impression rollers, it will be drawn therethrough, thereby transferring the ink on said blanket roller to said continuous web, said control means for activating said moving means including first and second micro-switches disposed adjacent the rotational axis of one of said plate and blanket rollers, and wherein said first micro-switch functions to activate said moving means which places said impression roller in contact with said blanket roller, and wherein said second micro-switch functions thereafter to deactivate said moving means thereby lowering said impression roller out of contact with said blanket roller, said control means further including means provided to vary the time lag between the activation of said first micro-switch and the activation of said second micro-switch such that the length of time said impression roller is in contact with said blanket roller may be varied for enabling the length of the printing on the continuous web to be adjusted, with said means for varying the time lag between the activation of said first micro-switch and the activation of said second micro-switch including a means for varying the position of one of said switches relative to the rotational axis of the associated roller.

2. An apparatus as recited in claim 1 further including cutting means for sizing the continuous web into individual labels.

3. An apparatus as recited in claim 2 wherein a third micro-switch is provided disposed adjacent the rotational axis of one of said plate and blanket rollers, and operatively associated with said cutting means, said third micro-switch for activating said cutting means to precisely cut off a label from said continuous web after it has been printed.

4. An apparatus as recited in claim 1 wherein said means for selectively moving said impression roller into or out of contact with said blanket roller includes a solenoid which when activated raises and maintains said impression roller in contact with said blanket roller, until such time as said solenoid is deactivated whereupon the impression roller is lowered downwardly away from said blanket roller.

5. An apparatus as recited in claim 1 wherein said ink module includes first and second inking rollers and an ink reservoir, with said ink reservoir supplying ink to said first inking roller and with said second inking roller being in contact with both said first inking roller and said plate roller such that the ink on said first inking roller is transferred via said second inking roller to said plate roller.

6. An apparatus as recited in claim 1 wherein said fountain solution module includes first and second fountain rollers and a fountain reservoir, said fountain reservoir including a wick to transfer the fountain solution from said reservoir to said first fountain roller and with said second fountain roller being in contact with said first fountain roller and said plate roller such that the fountain solution on said first fountain roller is transferred via said second fountain roller to said plate roller.

7. An apparatus as recited in claim 6 wherein said fountain solution module further includes a fountain solution supply means, said supply means for regulating the amount of fountain solution supplied to said fountain solution reservoir.

8. An apparatus as recited in claim 7 wherein said fountain solution supply means includes a feed pipe with an open end which is capable of movement relative to the depth of said fountain reservoir such that the depth of liquid maintained in said fountain reservoir is maintained at the point at which the open end of said feed pipe is placed.

9. An apparatus as recited in claim 1 wherein said means for attaching said master sheet to said plate roller includes a plurality L-shaped slots aligned along a groove parallel to the longitudinal axis of said plate roller, said slots for engaging L-shaped dogs provided along the side edge of said master sheet.

10. An apparatus as recited in claim 1 wherein said blanket cylinder has an elastomeric outer surface.

11. An apparatus for reproducing the indicia of a master sheet on a continuous web for printing labels of varying lengths comprising:

a rotatable plate roller, said plate roller having a means for attaching said master sheet thereto;

a fountain solution module for supplying a fountain solution to the master sheet on said plate roller;

an ink module positioned for supplying ink to said master sheet on said plate roller after said master sheet has been supplied with fountain solution;

a rotatable blanket roller having a diameter equal to the diameter of said plate roller, said blanket roller being in contact with said plate roller;

drive means connected to both said plate roller and said blanket roller with said rollers being rotated at the same speed such that the ink placed on said plate roller is accurately transferred to said blanket roller;

a rotatable impression roller, mounted for reciprocating movement into and out of contact with said blanket roller;

means for selectively moving said impression roller into or out of contact with said blanket roller;

control means for actuating said moving means, said control means including first and second micro-switches disposed adjacent the rotational axis of one of said plate and blanket rollers, said first micro-switch functioning to activate said moving means which places said impression roller into contact with said blanket roller, with said blanket roller causing said impression roller to rotate such that when said continuous web is fed adjacent the nip between said blanket and impression rollers it will be drawn therethrough thereby transferring the ink on said blanket roll to said continuous web, and wherein said second micro-switch functions to deactivate said moving means thereby lowering said impression roller out of contact with said blanket roller, and wherein the time lag between the activation of said first micro-switch and the activation of said second micro-switch may be varied, thereby varying the length of time said impression roller is in contact with said blanket roller whereby the length of the printing on the continuous web may be adjusted, with the time lag between the activation of said first micro-switch and the activation of said second micro-switch being varied by varying the position of one of said first and second micro-switches relative to the rotational axis of the associated roller;

cutting means, said cutting means for sizing the continuous web into individual labels after they have been printed; and a third micro-switch disposed adjacent the rotational axis of one of said plate and blanket rollers and operatively associated with said cutting means, said third micro-switch for activating said cutting means to precisely sever a label from said continuous web after it has been printed.

12. An apparatus for reporducing the indicia of a master sheet on a continuous web for printing labels comprising:

a rotatable plate roller, said plate roller having a means for attaching said master sheet thereto;

a fountain solution module for supplying a fountain solution to the master sheet on said plate roller;

an ink module positioned for supplying ink to said master sheet on said plate roller after said master sheet has been supplied with fountain solution, said ink module including first and second inking rollers and an ink reservoir, with said ink reservoir supplying ink to said first inking roller and with said second inking roller being in contact with both said first inking roller and said plate roller such that the ink on said first inking roller is transferred via said second inking roller to said plate roller, said ink reservoir being generally triangularly shaped and adapted to receive an elongated plastic sleeve having an opened end and containing ink, said ink reservoir having an upper cover, said upper cover being capable of pivoting downwardly into said reservoir thereby forcing ink contained in said plastic sleeve out of the reservoir and onto said first inking roller;

a rotatable blanket roller having a diameter equal to the diameter of said plate roller, said blanket roller being in contact with said plate roller;

drive means connected to both said plate roller and said blanket roller, with said rollers being rotated at the same speed such that the ink placed on said plate roller is accurately transferred to said blanket roller;

a rotatable impression roller mounted for reciprocating movement into and out of contact with said blanket roller;

means for selectively moving said impression roller into or out of contact with said blanket roller; and control means for actuating said moving means whereby when said impression roller is brought into contact with said blanket roller, said blanket roller will cause said impression roller to rotate such that when said continuous web is fed adjacent to the nip between said blanket and impression rollers, it will be drawn therethrough, thereby transferring the ink on said blanket roller to said continuous web.

13. An apparatus as recited in claim 12 wherein said top cover is downwardly biased by a screw means.

14. An apparatus as recited in claim 12 wherein said ink reservoir has an arcuate back end to permit the pivoting movement of said top cover thereby facilitating the extrusion of ink contained in said plastic sleeve.

15. An apparatus as recited in claim 12 wherein the lower edge of said triangularly shaped ink reservoir has a tapered end which abuts said first inking roller, said tapered end acting as a doctor blade to maintain a constant thickness layer of ink on said first inking roller.

* * * * *